US008073168B2

(12) United States Patent
Christian

(10) Patent No.: US 8,073,168 B2
(45) Date of Patent: Dec. 6, 2011

(54) COMPACT OPEN BAFFLE SPEAKER SYSTEM

(75) Inventor: Locksley Christian, Chandler, AZ (US)

(73) Assignee: Locksley A. Christian, Chandler, AZ (US)

( * ) Notice: Subject to any disclaimer, the term of this patent is extended or adjusted under 35 U.S.C. 154(b) by 1240 days.

(21) Appl. No.: 11/714,529

(22) Filed: Mar. 6, 2007

(65) Prior Publication Data

US 2008/0056516 A1 Mar. 6, 2008

Related U.S. Application Data

(60) Provisional application No. 60/840,748, filed on Aug. 29, 2006.

(51) Int. Cl.
*H04R 1/02* (2006.01)
*H04R 1/20* (2006.01)
*H04R 25/00* (2006.01)

(52) U.S. Cl. ..... 381/182; 381/351; 381/386

(58) Field of Classification Search ..... 381/386, 381/332, 335, 336, 396, 182, 345, 351; 181/144, 181/145, 153, 199

See application file for complete search history.

(56) References Cited

U.S. PATENT DOCUMENTS 4,004,094 A 1/1977 Ott
4,101,766 A 7/1978 Minami
4,450,929 A 5/1984 Marrs

FOREIGN PATENT DOCUMENTS

WO WO/9807297 * 2/1998

* cited by examiner

*Primary Examiner* — Tuan Nguyen
(74) *Attorney, Agent, or Firm* — Bay Area IP; Ariel Bentolila

(57) ABSTRACT

A speaker system is presented. The speaker system has a front speaker driver, a shroud mounted to the front speaker driver substantially encasing a cylinder volume on a rear portion of the front speaker driver. A rear speaker driver having similar dimensions to the front speaker is axially aligned with the front speaker driver and secured at a determined distance behind the front speaker driver and the shroud providing an air gap between the shroud and the rear speaker driver. An acoustically treated enclosure encloses a volume on a rear portion of the rear speaker driver. Electrical connections connect the front speaker driver and the rear speaker driver to terminals for connection to an external driving source such that like excursions occur on the front speaker driver and the rear speaker driver when the external driving source is operable and the front speaker driver functions in an open baffle system.

6 Claims, 14 Drawing Sheets

COMPACT OPEN BAFFLE SPEAKER SYSTEM

CROSS-REFERENCE TO RELATED APPLICATIONS

The present Utility patent application claims priority benefit of the [U.S. provisional application for patent Ser. No. 60/840,748, entitled "Compact Open Baffle Speaker System" and filed on Aug. 29, 2006 under 35 U.S.C. 119(e). The contents of this related provisional application are incorporated herein by reference for all purposes.

FIELD OF THE INVENTION

The present invention relates generally to acoustic reproduction devices. More particularly, the invention relates to a compact open baffle speaker system that is able to relatively efficiently and accurately reproduce low frequencies.

BACKGROUND OF THE INVENTION

Throughout the history of speaker system development the desire to create a compact speaker system that can reproduce low frequencies can easily be considered one of the highest goals of speaker manufacturers. The following is a brief description of current loudspeaker technology, describing the various types of speaker technologies that are related to this disclosure as well as the limitations of these technologies. Typically a driver of a speaker system is mounted in an enclosure, or cabinet. A major role of the enclosure is to prevent out-of-phase sound waves from the rear of the speaker from combining with positive phase sound waves from the front of the speaker, which result in cancellation. Cancellation causes the efficiency of the speaker to be compromised and produces interference particularly in low frequencies where the wavelengths are large enough that interference will affect the entire listening area. Enclosures also play a significant role in sound production, adding resonances, diffraction, and other unwanted effects. Increasing enclosure rigidity, adding internal damping and increasing the enclosure's mass are current approaches for reducing problems with resonance. Diffraction problems are addressed in the shape of the enclosure for example, without limitation, avoiding sharp corners on the front of the enclosure.

The ideal mount for a loudspeaker driver, or transducer, is a flat board of infinite size with infinite space behind it. Thus, the rear sound waves, or rarefaction, cannot cancel the front sound waves, or excursion. An "open baffle" loudspeaker is an approximation of this. In an open baffle loudspeaker, the transducer is mounted on a simple board of size comparable to the lowest wavelength to be reproduced. However, for many purposes this is impractical and the enclosure must use other techniques to maximize the output of the loudspeaker, also called loading. For example, without limitation, a wavelength of 20 Hz is approximately 56 ft long and is too large to be maximized with an open baffle loudspeaker.

FIGS. 1 and 2 illustrate an exemplary conventional art single driver open baffle system utilizing a large baffle to maximize low frequency reproduction. FIG. 1 shows a front view, and FIG. 2 shows a rear perspective view. In the present system a large baffle 20 is required to accommodate a single driver 21. In many applications the size of baffle 20 is too large for reasons such as, but not limited to, size constraints and aesthetics. For example, without limitation, most listeners would not want a speaker system with a large baffle in their home.

FIGS. 3 and 4 illustrate an exemplary conventional art multiple drive open baffle speaker system utilizing a narrow baffle 25 but compensating by employing more than one low frequency drivers 26. FIG. 3 shows a front view, and FIG. 4 shows a rear perspective view. In the present system and other systems where a narrow baffle is utilized, larger diameter low frequency drivers may be employed to compensate for the lack of baffle area.

Another prior art system is an "infinite baffle" system. FIGS. 5 and 6 illustrate an exemplary conventional art infinite baffle speaker system. FIG. 5 shows a front perspective view and FIG. 6 shows a rear perspective view. An infinite baffle speaker system is a variation on the open baffle system and is made by placing a loudspeaker 27 in a large sealed box 28. Sealed box 28 is typically filled with acoustic absorbing material such as, but not limited to, foam, pillow stuffing, fiberglass, or other wadding. This enables loudspeaker 27 to behave as if loudspeaker 27 has a larger cabinet behind it.

Other types of conventional enclosures attempt to improve the low frequency response or overall efficiency of the loudspeaker by using various combinations of reflex or passive radiating elements to transmit the energy from the rear of the speaker to the listener; these enclosures may also be referred to as vented or ported enclosures, bass reflex, or transmission lines. FIG. 7 illustrates an exemplary conventional art vented enclosure 29. Vented enclosure 29 comprises a vent 30. The interiors of such enclosures are also often lined with fiberglass matting for absorption. Reflex ports are tuned by the amount of mass within the vent, using appropriate diameter and length to reach this point. This enclosure is the most common conventional enclosure as it lends itself to small size and reasonable bass.

As shown by way of example in FIGS. 1 through 7, conventional enclosures are large, bulky, and some of them require multiple speaker drivers. In view of the foregoing, there is a need for an improved speaker system for maximizing low frequency reproduction that is small and efficient.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1 shows a front view, and FIG. 2 shows a rear perspective view;

FIG. 3 shows a front view, and FIG. 4 shows a rear perspective view;

FIG. 5 shows a front perspective view and FIG. 6 shows a rear perspective view;

FIG. 8 is a cross-sectional view that does not include numerical labeling of individual elements, and FIG. 9 is a cross-sectional view that does include numerical labeling of the elements. FIG. 10 shows a front view of the open baffle speaker system, and FIG. 11 shows a rear view of the open baffle speaker system;

Figure 1:
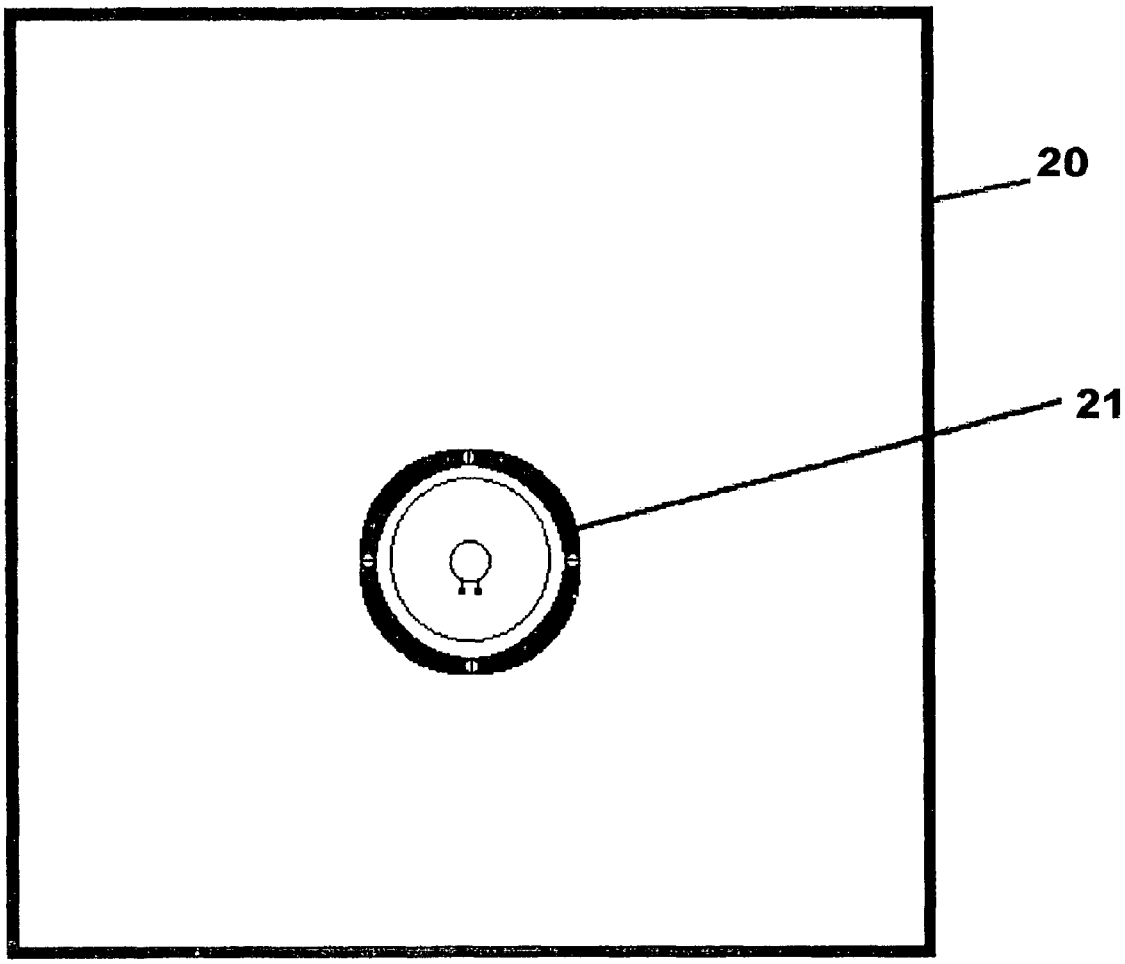
Figure 1 (prior art)
FIGS. 1 and 2 illustrate an exemplary conventional art single driver open baffle system utilizing a large baffle to maximize low frequency reproduction.
Figure 2:
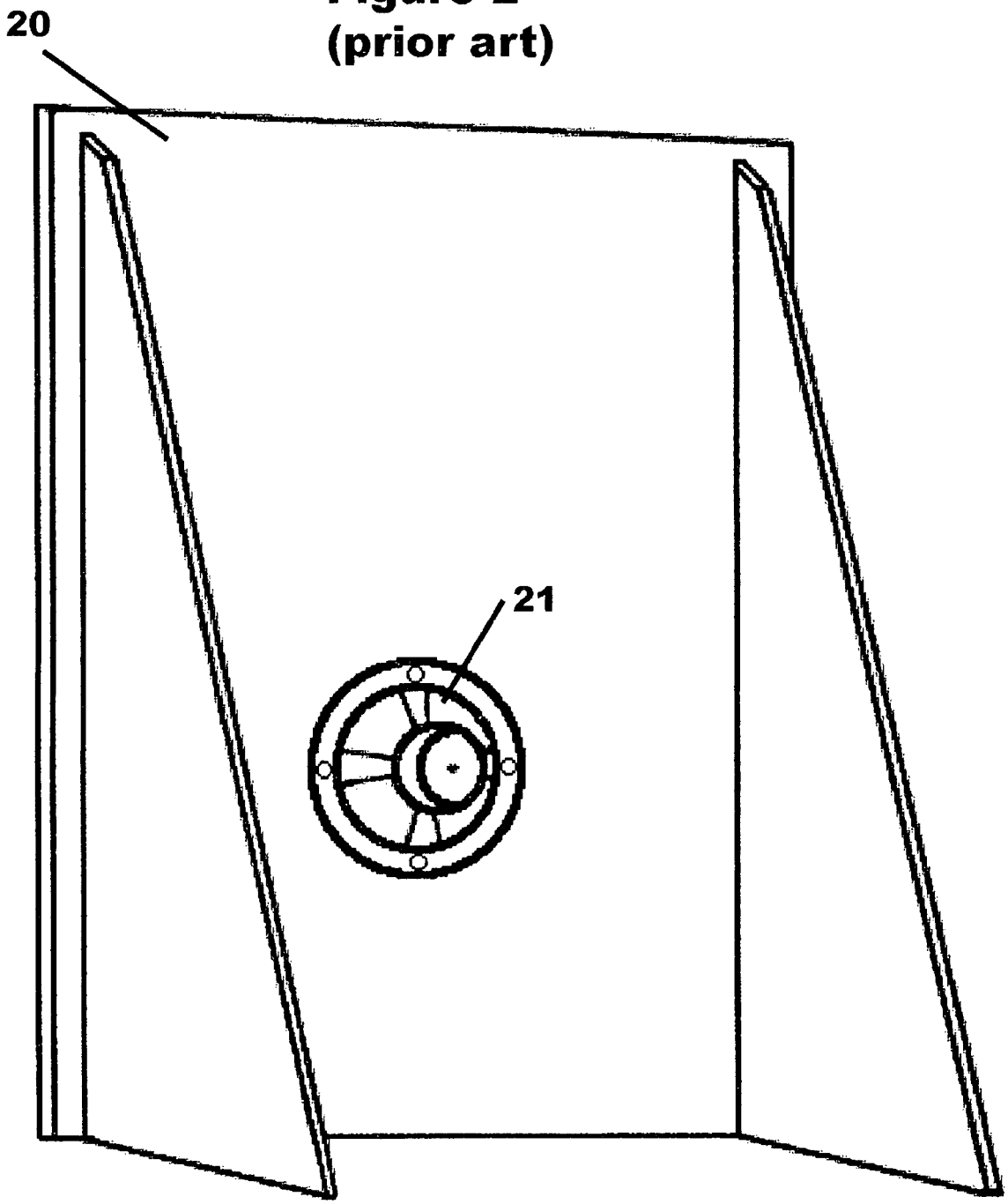
Figure 2 (prior art)
Figure 3:
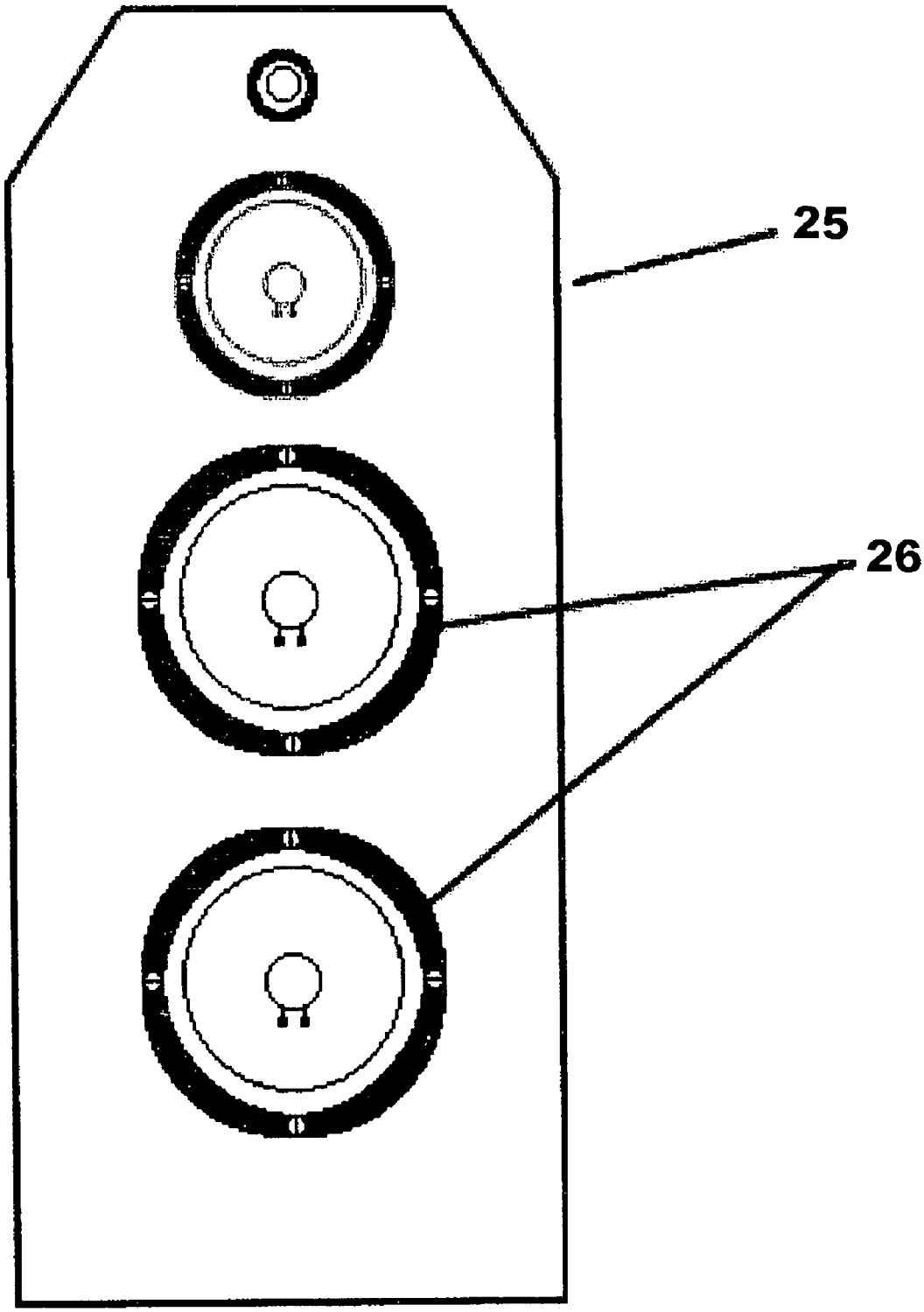
Figure 3 (prior art)
FIGS. 3 and 4 illustrate an exemplary conventional art multiple driver open baffle speaker system utilizing a narrow baffle but compensating by employing more than one low frequency drivers.
Figure 4:
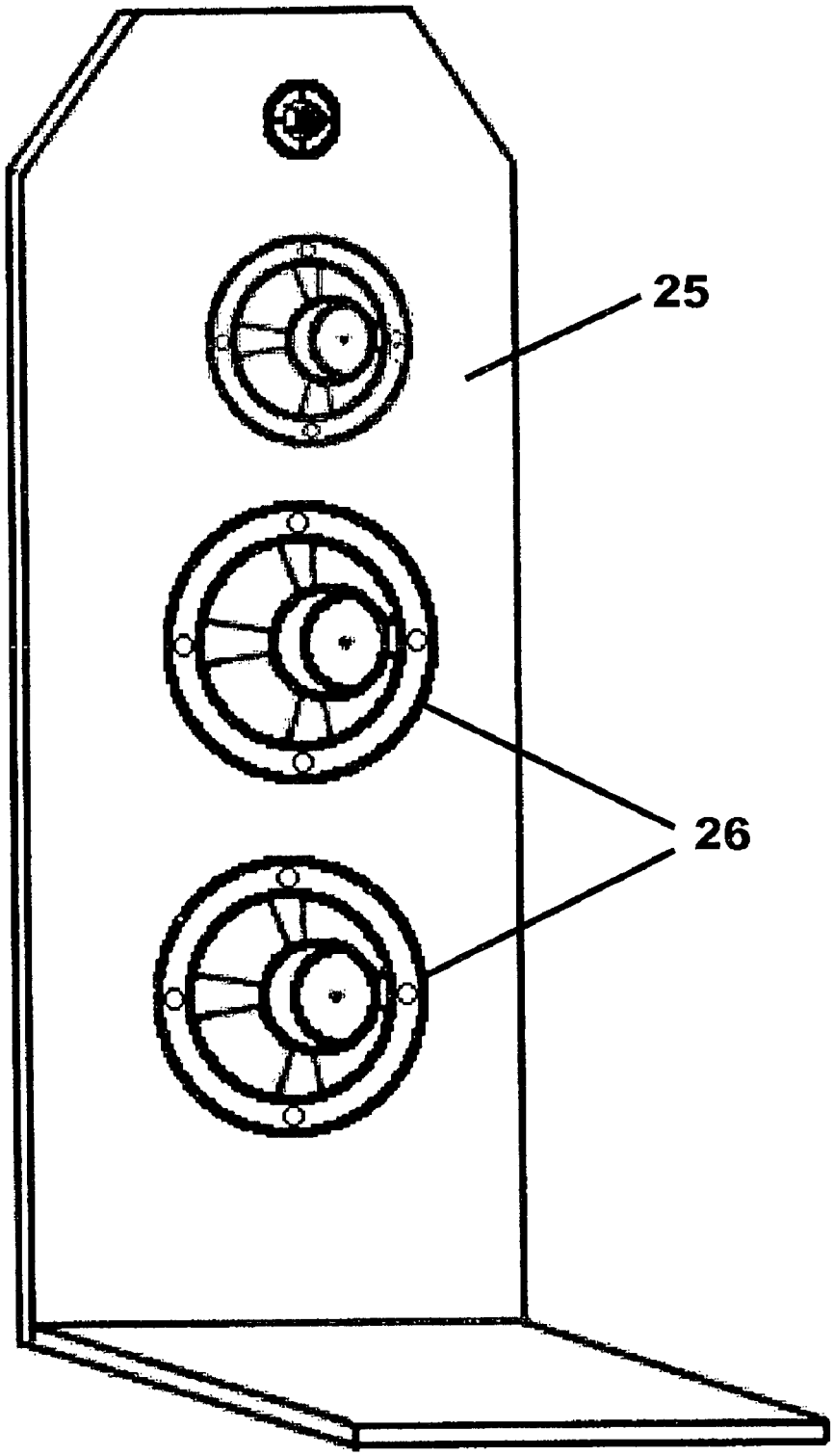
Figure 4 (prior art)
Figure 5:
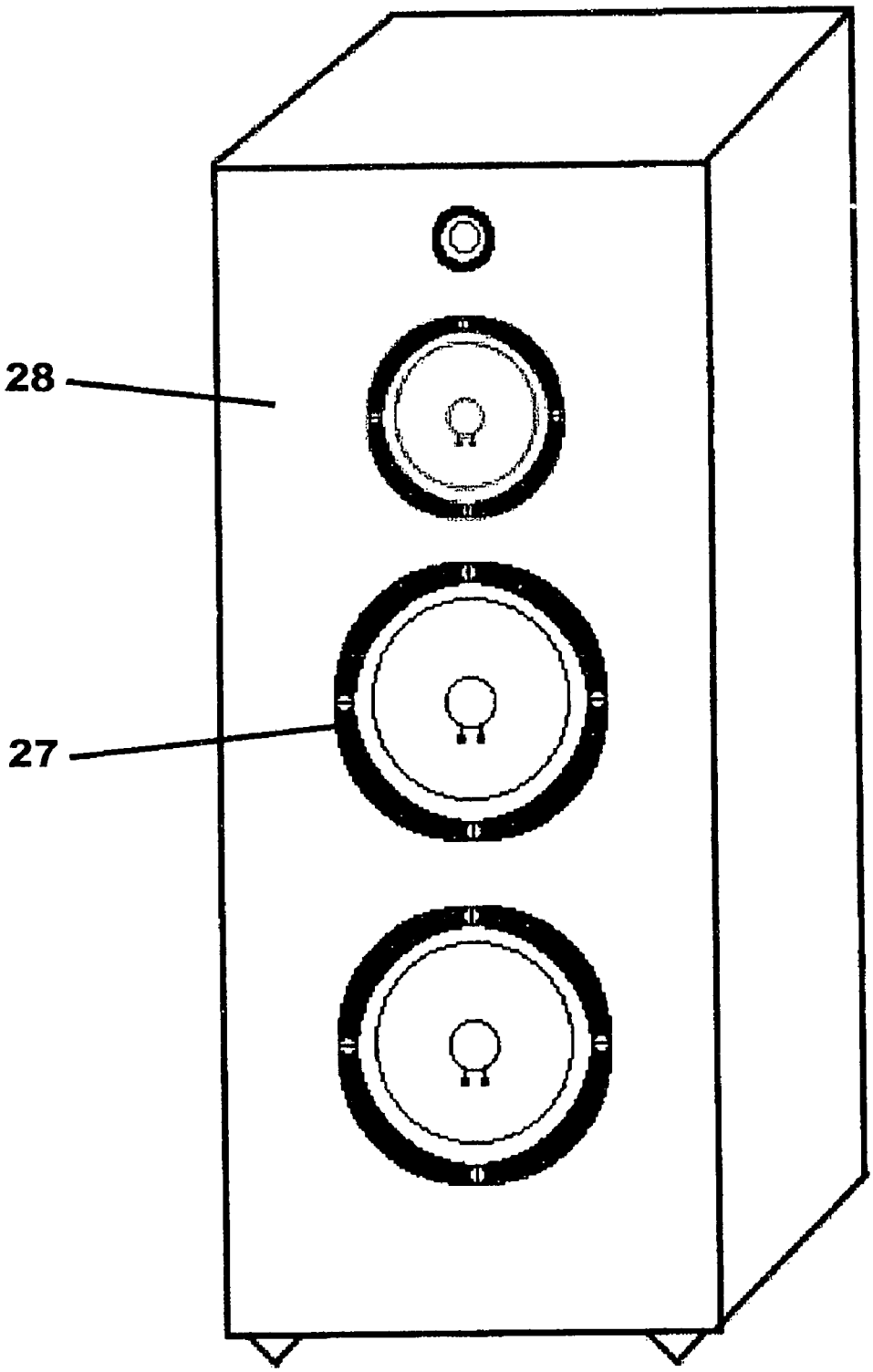
Figure 5 (prior art)
FIGS. 5 and 6 illustrate an exemplary conventional art infinite baffle speaker system.
Figure 6:
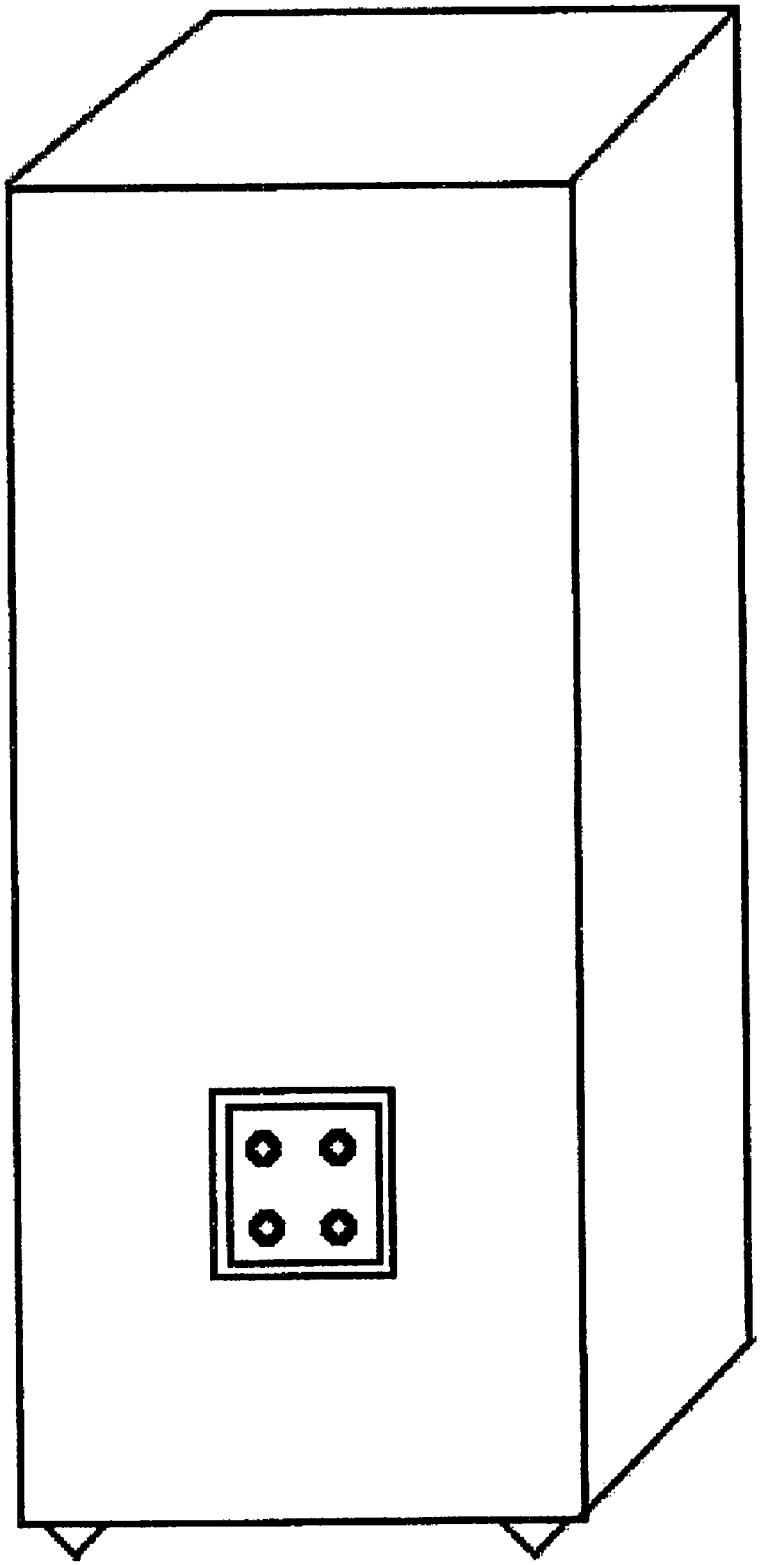
Figure 6 (prior art)
Figure 7:
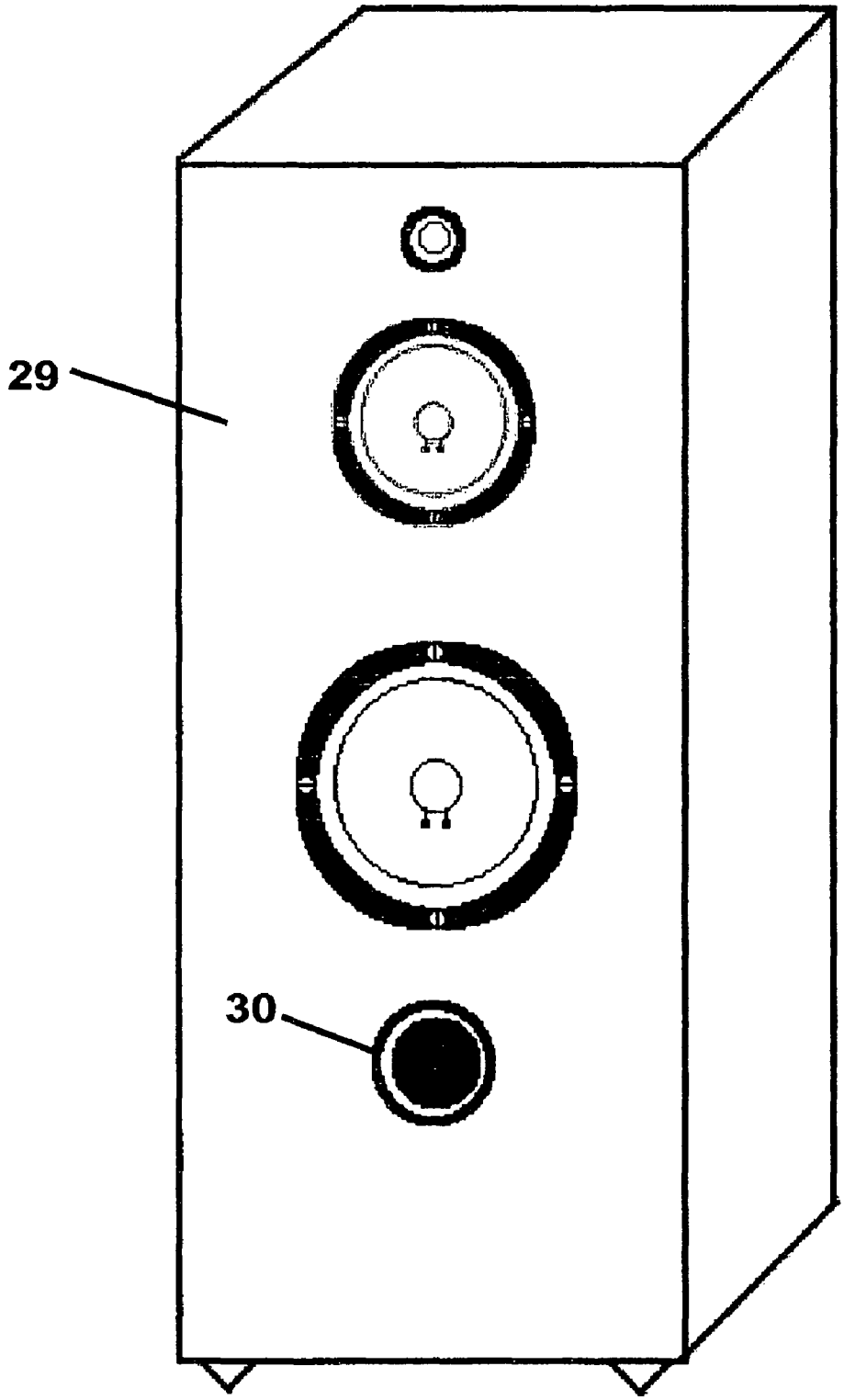
Figure 7 (prior art)
FIG. 7 illustrates an exemplary conventional art vented enclosure.

Unless otherwise indicated illustrations in the figures are not necessarily drawn to scale.

SUMMARY OF THE INVENTION

To achieve the forgoing and other objects and in accordance with the purpose of the invention, a compact open baffle speaker system is presented.

In one embodiment, a speaker system is presented. The speaker system comprises a front speaker driver, a shroud mounted to the front speaker driver substantially encasing a cylindrical volume on a rear portion of the front speaker driver. A rear speaker driver comprising similar dimensions to the front speaker driver is axially aligned with the front speaker driver and secured at a determined distance behind the front speaker driver and the shroud providing an air gap between the shroud and the rear speaker driver. An acoustically treated enclosure substantially encloses a volume on a rear portion of the rear speaker driver. Electrical connections connect the front speaker driver and the rear speaker driver to connection terminals for connection to an external driving source such that like excursions occur on the front speaker driver and the rear speaker driver when the external driving source is operable and the front speaker driver functions in an open baffle system. In another embodiment, the front speaker driver, shroud, rear speaker driver, and enclosure are secured together by attachment means. In another embodiment, the dimensions of the air gap can be controlled for tuning the efficiency of the speaker system. In a further embodiment, the determined distance can be controlled for in part effecting a tuning of a natural mechanical crossover of the speaker system. In another embodiment, the connection terminals are mounted on the enclosure. In yet another embodiment, the speaker system further comprising a mounting means for placement of the speaker system on a secure structure. In still another embodiment, the speaker system further comprises a higher frequency speaker driver mounted to the speaker system and electrically connected to the external driving source. In another embodiment, the speaker system further comprises a cross-over system to distribute the external driving source. In another embodiment, the front speaker driver and the rear speaker driver have dissimilar resonant frequencies to prevent distortion due to summing. In yet another embodiment, the enclosure has a pressure release hole. In a further embodiment, the front speaker driver and the rear speaker driver function as a sub-woofer in a multi channel audio system. In still another embodiment, the front speaker driver, the rear speaker driver and the higher frequency speaker driver function as a full-range speaker system in a multi channel audio system.

In another embodiment, a speaker system is presented. The speaker system comprises a rear speaker means for operating a rear speaker in an infinite baffle, a front speaker means for operating a front speaker in conjunction with the rear speaker in an open baffle, and a connection means for electrically connecting the front and rear speakers to an external driving source. In a further embodiment, the speaker system further comprises a mounting means for placement of the speaker system on a secure structure. In yet another embodiment, the speaker system further comprises a means for including a higher frequency speaker. In still another embodiment, the speaker system further comprises a crossover means for distributing the external driving source.

In another embodiment, a multi channel speaker system is presented. The multi channel speaker system comprises a plurality of speaker systems, each of the speaker systems comprising a rear speaker means for operating a rear speaker in an infinite baffle, a front speaker means for operating a front speaker in conjunction with the rear speaker in an open baffle, a means for including a higher frequency speaker, and a connection means for electrically connecting the front, rear and higher frequency speakers to a channel of an external driving source. In a further embodiment, each of the speaker systems further comprises a mounting means for placement of the speaker system on a secure structure. In yet another embodiment, each of the speaker systems further comprises a crossover means for distributing the channel of the external driving source. In another embodiment, the multi channel speaker system further comprises a subwoofer comprising a rear speaker means for operating a rear speaker in an infinite baffle, a front speaker means for operating a front speaker in conjunction with the rear speaker in an open baffle, and a connection means for electrically connecting the front and rear speakers to a subwoofer channel of an external driving source.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments.

The present invention will now be described in detail with reference to embodiments thereof as illustrated in the accompanying drawings.

An aspect of the present invention is to enable a loudspeaker system to be made to small dimensions while still producing the lowest octaves of the audible spectrum. Embodiments of the present invention enable the size of a front baffle of an open baffle speaker system, which normally requires the largest possible size baffle to adequately reproduce the lowest possible notes, to be reduced to roughly the same diameter as the speaker's low frequency driver. In these embodiments, a partial shroud, or curved front baffle, is placed over a front bass driver, which is coupled to a second rear bass driver of similar bass frequency specifications, while leaving an air gap between the shroud and the rear bass driver. This enables the rarefaction pressure waves produced by the front driver to be canceled when both drivers are energized, in the same direction, by the same signal, thus the excursion of the rear driver, moving in sync with the front driver, presents a relatively stable environment for the front driver. This enables the front driver to reproduce its lowest possible frequencies. In embodiments of the present invention, the rarefaction wave of the rear bass driver is contained by placing an acoustically treated enclosure, or infinite baffle, behind the rear bass driver. Since the movement of the rear bass driver is somewhat restricted relative to the front bass driver in these embodiments, due to the minimal enclosure size behind the rear bass driver, the air gap provided between the shroud and the rear driver frame allows excess air pressure to be taken in or expelled.

Figure 8:
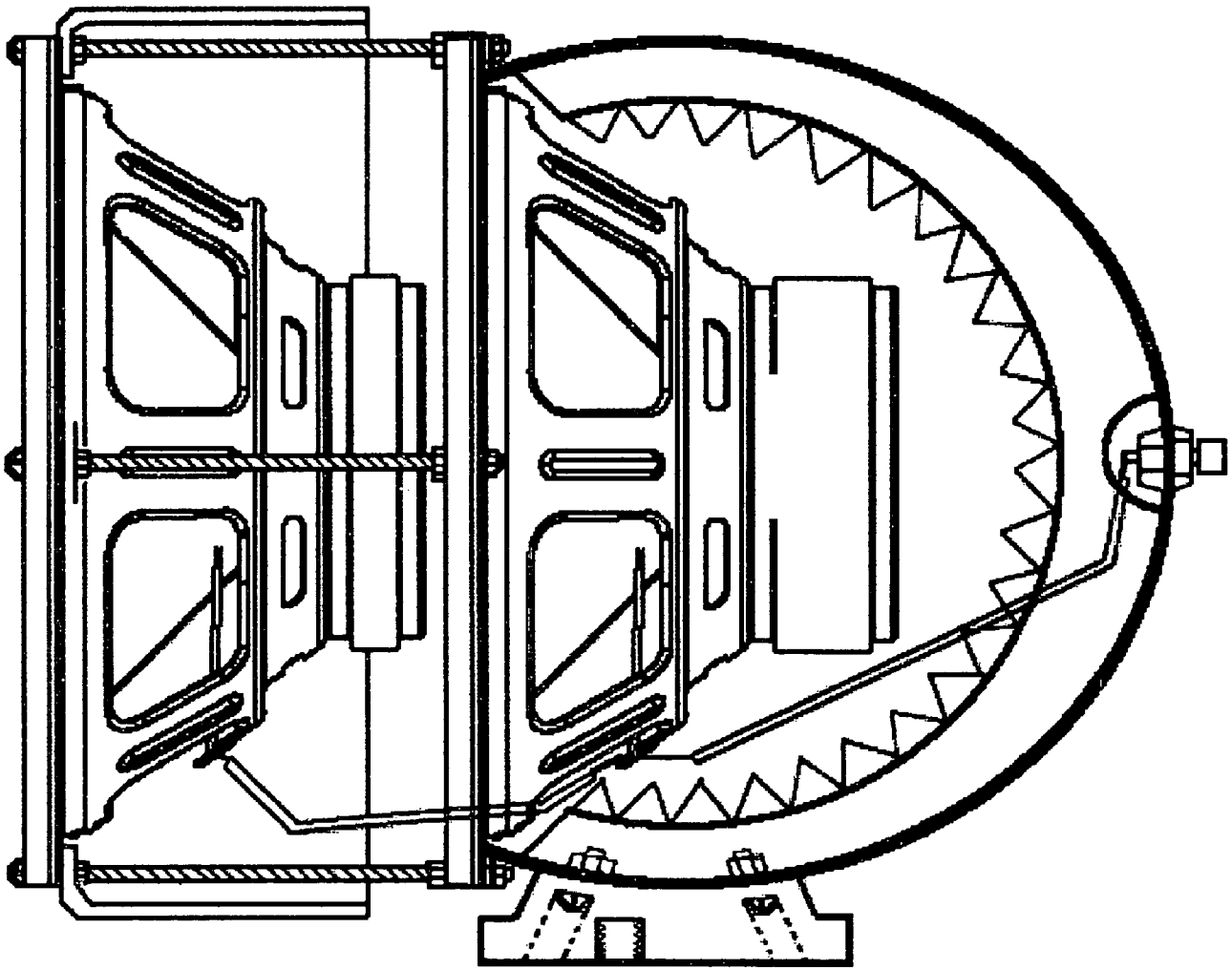
FIGS. 8, 9, 10, and 11 illustrate an exemplary compact open baffle speaker system, in accordance with an embodiment of the present invention.
Figure 9:
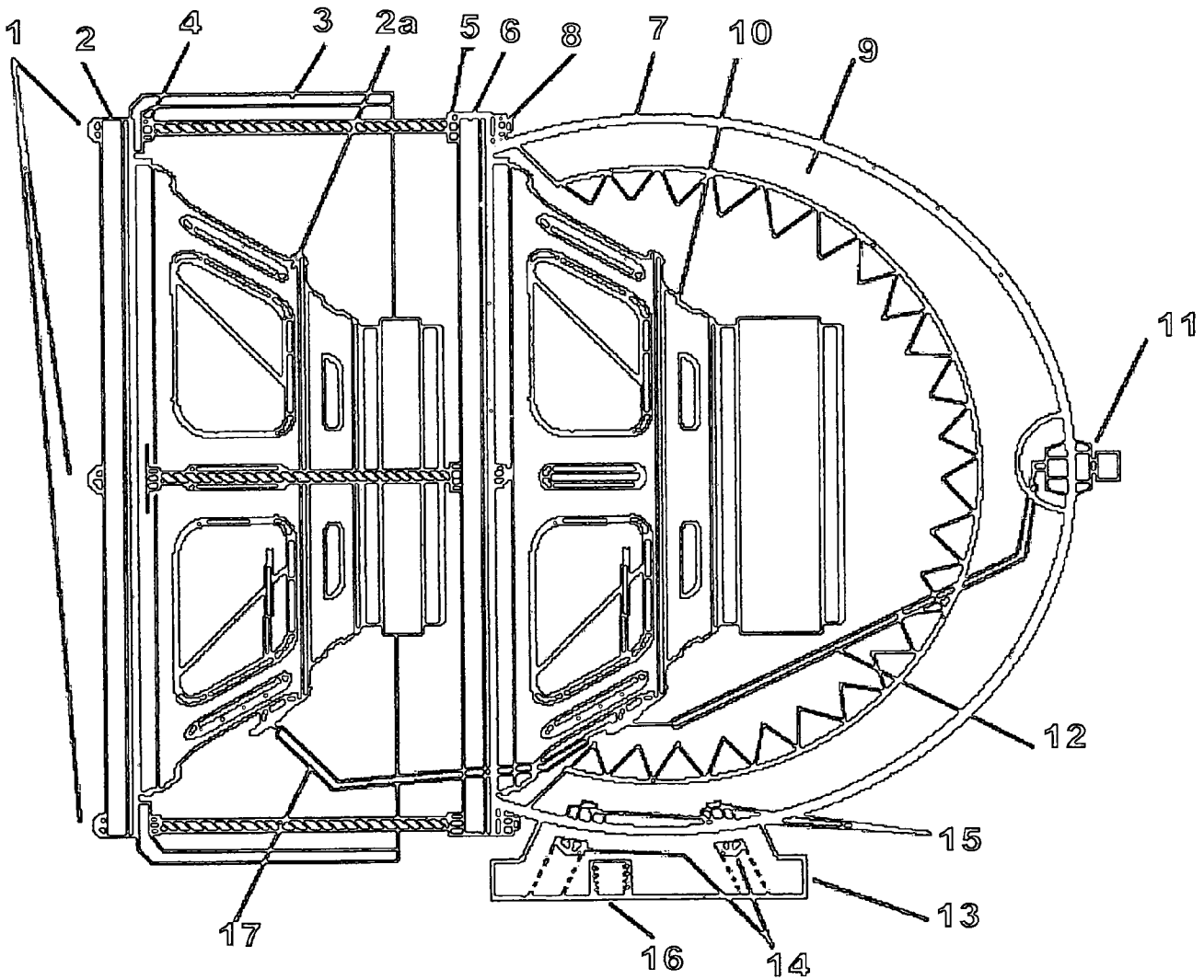
Figure 10:
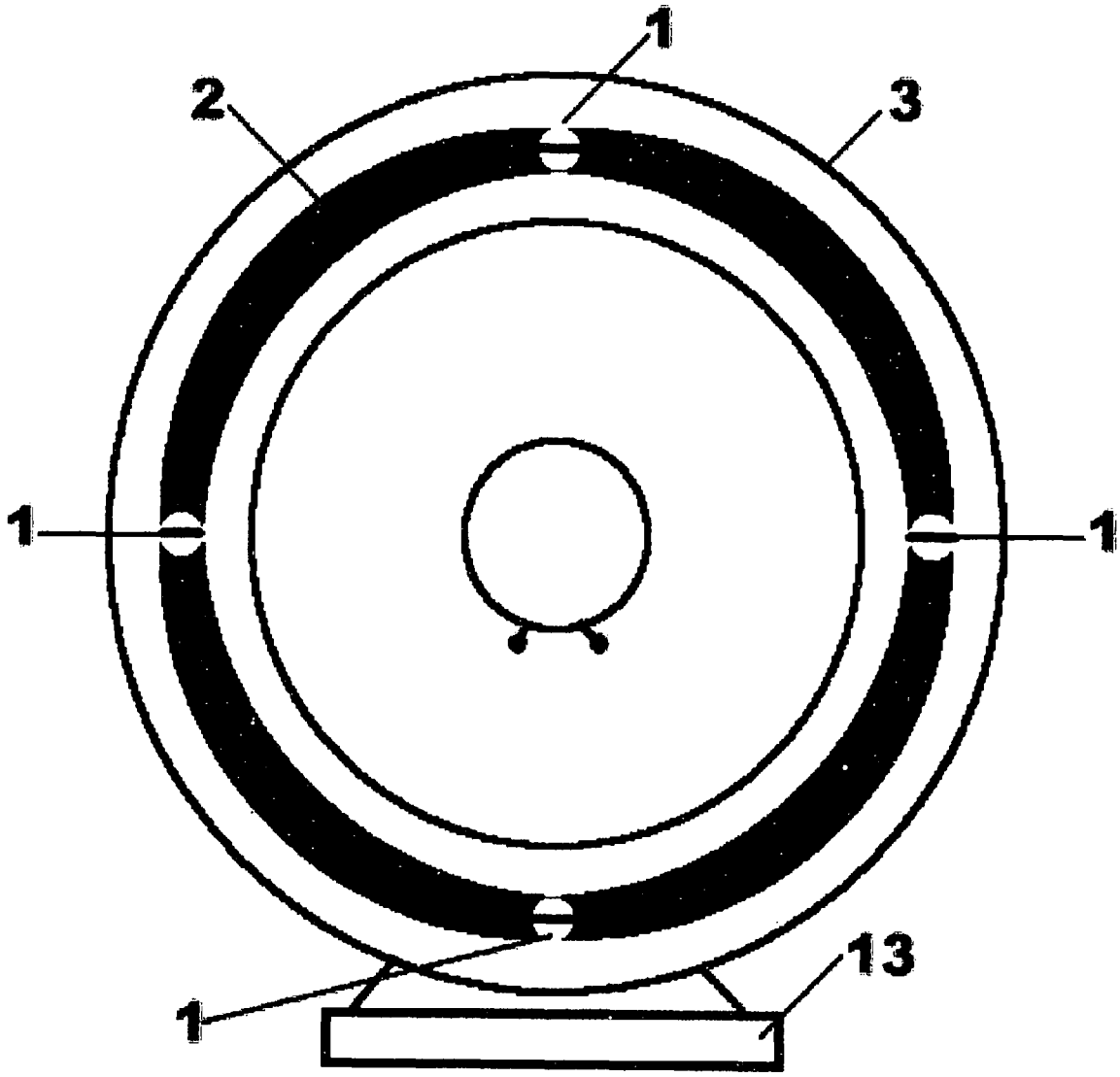
Figure 11:
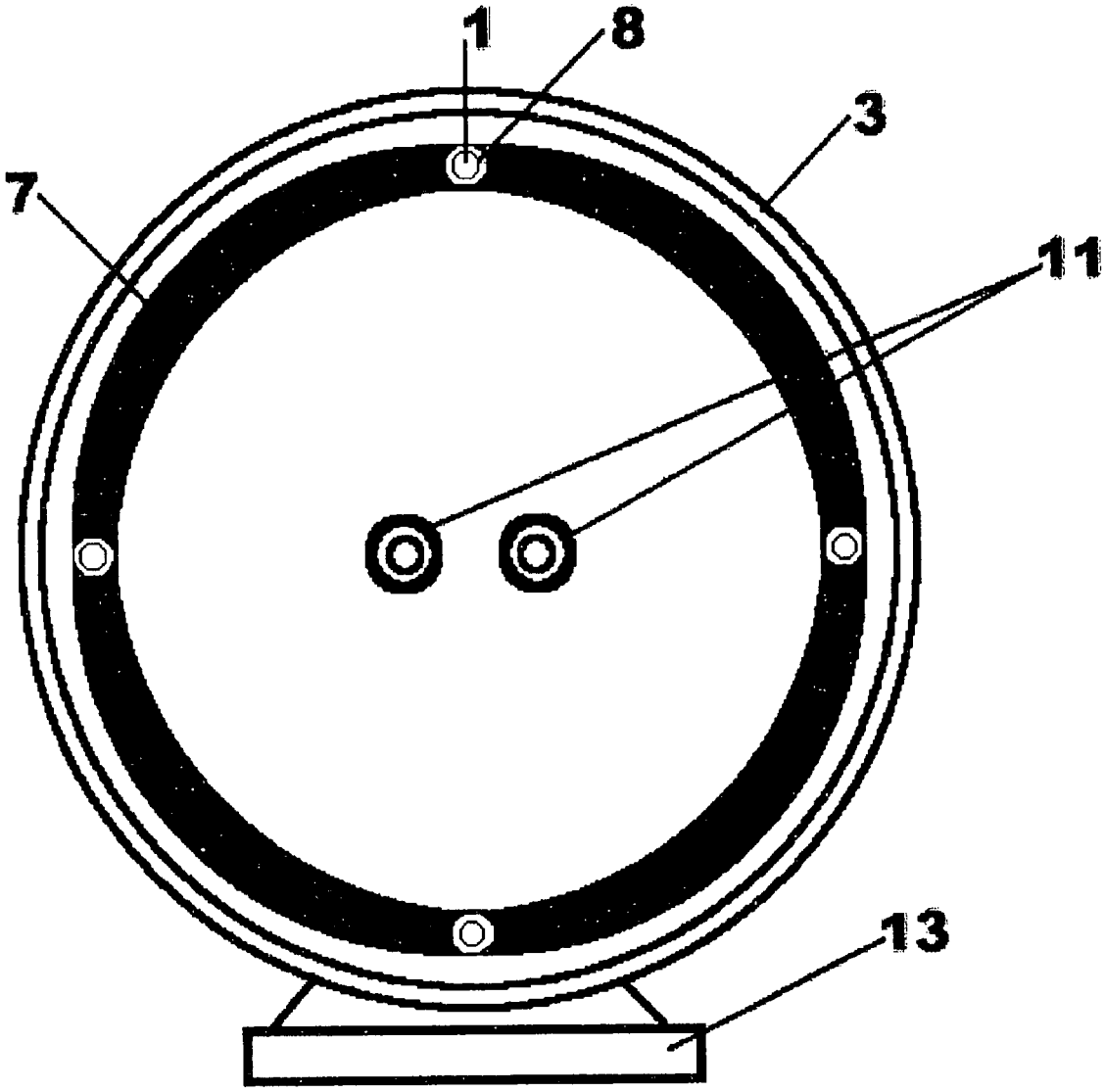

FIGS. 8, 9, 10, and 11 illustrate an exemplary compact open baffle speaker system, in accordance with an embodiment of the present invention. FIG. 8 is a cross-sectional view that does not include numerical labeling of individual elements, and FIG. 9 is a cross-sectional view that does include numerical labeling of the elements. FIG. 10 shows a front view of the open baffle speaker system, and FIG. 11 shows a rear view of the open baffle speaker system. The present embodiment is a loudspeaker system that can be used where a compact full-range or compact sub-woofer system is required, for example, without limitation, in a home theater, stereo music listening, or multichannel listening environment. The present embodiment, without additional drivers, may function as a mid to low frequency loudspeaker and can function as a 'sub-woofer' when connected to an active sub-woofer output of an amplifier. In a full-range configuration the present embodiment may be utilized with a high frequency driver or drivers to compliment the natural low frequency support of the embodiment. In some embodiments, an auxiliary cross-over system to manage the distribution of the audio signal to all drivers in a full range speaker system, may be added through the attachment of an external module or installed internally to the system.

In the present embodiment, bolts 1 are placed through holes in a primary speaker driver frame 2 and are passed through holes in a containment shroud 3. In alternate embodiments, alternate means of support may be used rather than bolts 1, for example, without limitation, smooth rods, panels, brackets, etc. In alternate embodiments, bolts 1 may also function as the supportive frame for the entire system.

In the present embodiment, a nut 4, or alternate fastener such as, but not limited to, screws, glue, or welded joints, is secured to each bolt 1 to apply sufficient pressure on containment shroud 3 to substantially insure an airtight and immovable attachment to primary speaker driver frame 2. Fasteners 5 are secured onto bolts 1 at a predetermined distance on bolts 1, determined by driver specifications, and pass through holes in a rear speaker frame 6. Fasteners 5 then pass through holes on the frame of a rear enclosure 7 providing an airtight seal. Fasteners 8 are secured to the ends of bolts 1. In an alternate embodiment, containment shroud 3 may be used as the supportive structure or frame for front speaker driver 2*a* by securing containment shroud 3, comprising appropriate vents, to rear enclosure 7.

The present embodiment comprises a rear speaker driver 10. However, alternate embodiments may comprise two or more rear speaker drivers depending on factors such as, but not limited to, the driver specifications and the application of the system. In the present embodiment, the spacing between the open end of containment shroud 3 and rear speaker frame 6 of rear speaker driver 10 determines the efficiency of low frequency, or bass, reproduction of the system, depending on the driver(s) specifications. To maximize efficiency and compactness in the present embodiment, front speaker 2*a* is placed as close as possible to rear speaker driver 10.

In the present embodiment, rear enclosure 7 is lined with an acoustic absorbing material 9 such as, but not limited to, foam, pillow stuffing, fiberglass, or other wadding and provides a closed baffle to rear speaker driver 10 to prevent rarefaction, or backwards, pressure from canceling the excursion, or frontward, pressure. In alternate embodiments rear enclosure 7 may not be lined with any type of acoustic absorbing material. In the present embodiment, speaker binding posts 11, for positive and negative polarities, are mounted on rear enclosure 7 to transmit electrical audio information through connector wires 12 to rear speaker driver 10. Another set of conductor wires 17 travel from rear speaker driver 10 to front speaker driver 2*a* thereby completing the internal circuitry of the present embodiment. Those skilled in the art, in light of the present teachings, will recognize that there are various alternate approaches to wiring a speaker system according to embodiments of the present invention, and the wiring scheme shown by way of example in the present embodiment may be changed in alternate embodiments.

Front speaker driver 2*a* and rear speaker driver 10 can be connected in parallel or in series depending on the impedance required for the system and the particular application of the system. Those skilled in the art, in light of the present teachings, will recognize that various types of mounts or bases can be attached to the system, for example, without limitation, various shapes and sizes. In the present embodiment, a mount 13 is shown with securing bolts 14 secured by nut fasteners 15 to rear enclosure 7. In the present embodiment, mount 13 has a threaded opening 16 that enables the system to be mounted to a standard tripod stand mount for example, without limitation, to be raised off of the floor.

In a typical application, the present embodiment operates by employing a rear speaker driver 10 that is similarly specified as and sits behind front speaker driver 2*a* with open air space between the two drivers. For particular applications in alternate embodiments, rear speaker driver 10 may be dissimilarly specified from front speaker driver 2*a*. In the present embodiment, front speaker driver 2*a* and rear speaker driver 10 move synchronously. The open space between the rear of containment shroud 3 and rear speaker frame 6 enables free movement of excess air or acoustic pressure. This excess air or acoustic pressure is created due to the unequal travel of cones of front speaker driver 2*a* and rear speaker driver 10, especially at high power. The cone of rear speaker driver 10 moves less than the cone of front speaker driver 2*a* because of rear speaker driver 10 is in a closed baffle system within rear enclosure 7, which has limited movement due to the restriction of air compression and expansion. Controlling the distance of the opening between containment shroud 3 and rear driver frame 6 allows for tuning of the efficiency of the system. In the present embodiment, rear speaker driver 10 eliminates the need for a large front baffle area by providing a stable, consistent, equalized pressure behind front speaker driver 2*a*, thus preventing the rarefied back pressure of front speaker driver 2*a* from canceling the low frequency tones, or bass notes, produced by the excursion of front speaker drivers 2*a*. Rear speaker driver 10 is configured as a closed baffle, also known as an infinite baffle. As described previously, a closed/infinite baffle speaker system has a sealed enclosure, thus preventing rarefaction pressure from canceling excursion pressure. The large dimensions normally required for a closed baffle speaker are not required in the present embodiment because rear speaker driver 10 is not used as the primary speaker driver; rear speaker driver 10 is functioning as a rear supportive driver, of which, full cone motion is not required for this system to function, as functional prototypes have demonstrated.

The arrangement of the present embodiment, allows for a very compact, full-range, speaker system. For example, without limitation, no large enclosure or front baffle is needed to produce full bass response. In the present embodiment, front speaker driver 2*a* and rear speaker driver 10 have dissimilar resonant frequencies to prevent distortion due to summing.

Also, since front speaker driver 2*a* is arranged as an open baffle, the cone of front speaker driver 2*a* can travel unrestricted, thus producing the most natural, non-compromised sound.

In alternate embodiments where rear speaker driver 10 may generate too much displacement relative to the volume of rear enclosure 7, a pressure release hole may be made at the lower rear of rear enclosure 7 to dissipate this extra pressure. This would also allow the cone of rear speaker driver 10 to move more freely.

In some embodiments, a protective acoustic grill, or speaker grill, can be placed in front of the system. Also in some embodiments, a protective screen may be place around the air gap between containment shroud 3 and rear speaker frame 6. In some embodiments, this protective screen can also be in the form of an adjustable deflector array to direct unwanted internal low frequency sound away from nearby acoustically reflective surfaces.

Depending on the spacing between front speaker driver 2*a* and rear speaker driver 10, the mutual perimeter space, or enclosure, between the drivers can be adjusted to tune the natural mechanical cross-over of the system. This mechanical cross-over function feature occurs because as the frequency of the supplied signal, for example, without limitation, from a stereo amplifier, is increased, the wavelength of the supplied signal becomes shorter, thus decoupling the interaction between front speaker driver 2*a* and rear speaker driver 10, allowing front speaker driver 2*a* to reproduce higher frequencies without undue interaction from rear speaker driver 10. Another way of stating the above is that at a certain minimum wavelength the influence of rear speaker driver 10 is not needed since the shorter wavelengths produced by front speaker driver 2*a* are not affected by cancellation due to the rarefaction of front speaker driver 2*a,* where front speaker driver 2*a* is required to reproduce lower treble or mid bass frequencies. This is due to the fact that shorter wavelengths are more directional than longer wavelengths.

Since the present embodiment is not a sealed front speaker system it is not necessarily isobarically loaded. Instead, the system is wavelength or acoustically loaded because the interaction between front speaker driver 2*a* and rear speaker driver 10 is wavelength dependent. Since front speaker driver 2*a* is not sealed in the present embodiment, the system behaves as an open baffle speaker system. This allows front speaker driver 2*a* to travel freely due to the lack of enclosure restrictions, allowing for the most natural tone reproduction. Also, since no front baffle is required, problems with sound diffraction are minimized. In the present embodiment, no parallel sides comprise the enclosure, thus no standing waves are generated, which would compromise the original reproduced sound.

The enclosure material is not critical in the present embodiment, as with standard closed baffled speaker systems, therefore, inexpensive and lighter materials can be used for construction such as, but not limited to, plastic. Although, higher powered embodiments may require proportionally stronger materials such as, but not limited to, metal, wood, or composite materials.

Embodiments of the present invention provide a very compact open baffle speaker system enabling the smallest possible size of enclosure to be used for reproducing the lowest frequencies, for example, without limitation, an ultra compact sub-woofer. This enables portability and placement flexibility because of the compact size of the system. Also, the small size provided by embodiments of the present invention enable full-range 'Near field' listening without the typical low frequency artifacts produced by other prior-art design methods. Embodiments of the present invention also provide accurate bass frequency reproduction due to the lack of a box or similar compromising enclosure.

Figure 12:
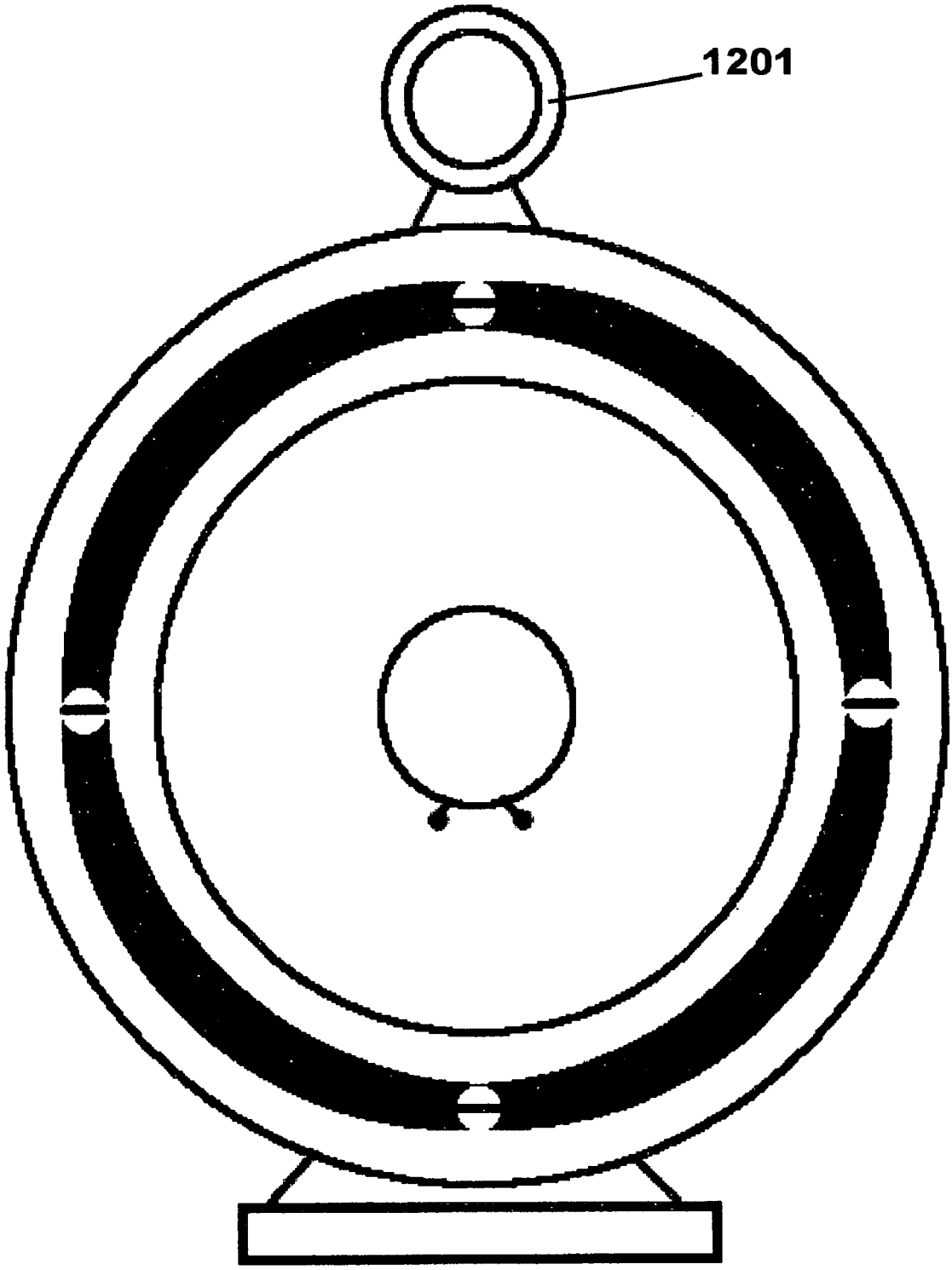
FIG. 12 shows a front view of an exemplary compact open baffle speaker system with a high frequency driver, in accordance with an embodiment of the present invention.

FIG. 12 shows a front view of an exemplary compact open baffle speaker system with a high frequency driver 1201, in accordance with an embodiment of the present embodiment. The addition of high frequency driver 1201 enables the present embodiment to function as a full range loudspeaker. In the present embodiment a single bass driver, with the addition of a high frequency driver or tweeter, comprises the system. Alternate embodiments may comprise multiple bass drivers, multiple high frequency drivers, or multiple drivers of both types. This coupling of bass unit and high frequency driver(s) can be used for all applicable channels in a multichannel listening environment, as shown by way of example in FIG. 13.

Figure 13:
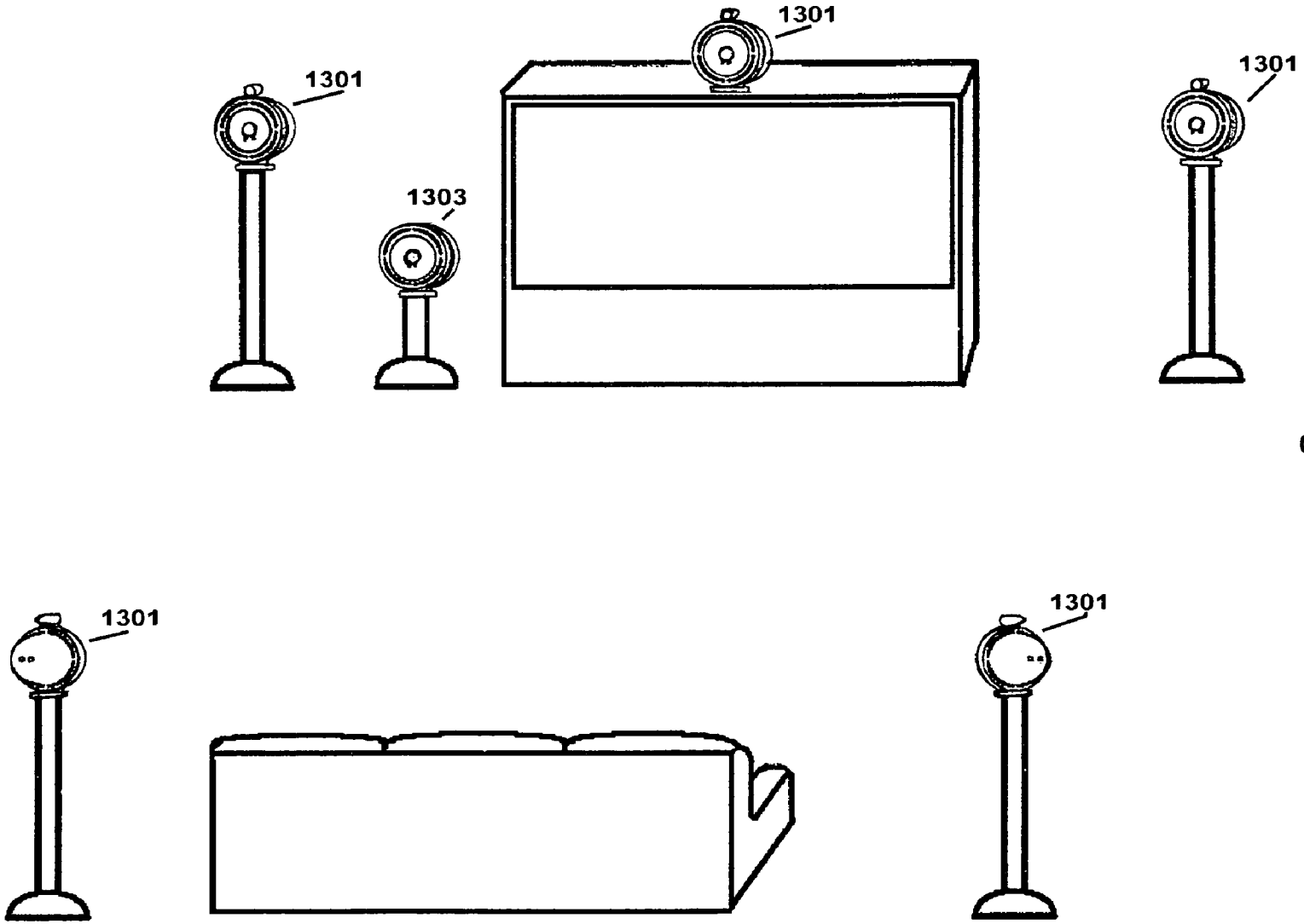
FIG. 13 shows an exemplary application of exemplary compact open baffle speaker systems, in accordance with an embodiment of the present invention.

FIG. 13 shows an exemplary application of exemplary compact open baffle speaker systems 1301, in accordance with an embodiment of the present invention. The present example is a home theater or multichannel environment comprising a compact open baffle system. In this application compact open baffle systems 1301 according to the embodiment of the present invention shown by way of example in FIGS. 8, 9, 10 and 11 are utilized for all channels supported by an amplifier. It should be noted that in many practical applications, subwoofer 1303 is not used during multi-channel music playback (e.g., for SACD or DVD Audio). For listening situations such as, but not limited to, a home theater or multichannel music listening, which require multiple speakers situated around the listening area, minimal space is required for speaker placement due to the small size of the system. Also, by using a speaker model according to embodiments of the present invention, except for the sub-woofer, timbrel matching can be accomplished in all channels of surround sound applications for example, without limitation, in a home theater or multichannel listening environment. This timbrel matching is more easily accomplished by using embodiments of the present invention, whether the speaker size parameter is set to small or large. The limitation with the conventional art is that standard full-range speakers are too large to be positioned in all required locations in most listening environments.

Embodiments of the present invention also enable optimal bass management to be obtained when listening to multichannel playback devices, such as, but not limited to, SACD or DVD-A players, since the ability to use full-range speakers on all channels enables the optimal performance parameters of the devices to be met. In an alternate embodiment, the system may be in the form of a sub-woofer. In this embodiment, the compact size of the system enables more than one sub-woofer units to be utilized, to increase power output, without occupying much space.

Figure 14:
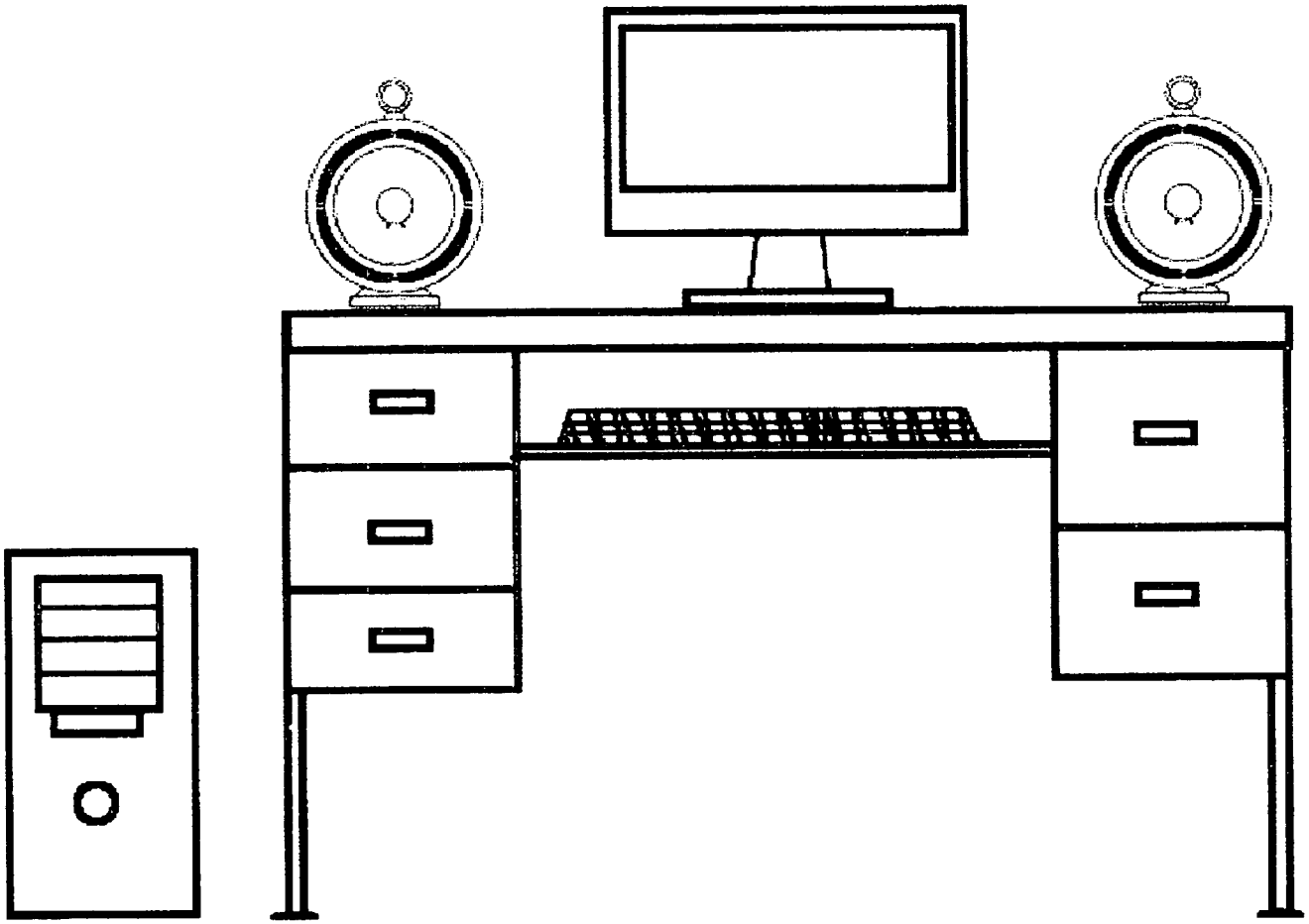
FIG. 14 shows an exemplary application of exemplary compact open baffle speaker systems as used in a personal computer listening environment, in accordance with an embodiment of the present invention.

FIG. 14 shows an exemplary application of exemplary compact open baffle speaker systems 1401 as used in a personal computer listening environment, in accordance with an embodiment of the present invention. The present example employs embodiments of the present invention that comprises high frequency drivers, as shown by way of example in FIG. 12. This provides the listener with a full range speaker system that is relatively small, which is desirable for a desktop application. Due to the potential of the system to reproduce the lowest musical notes, depending on the driver specifications, the listener would not require the use of a subwoofer in this example.

The above described embodiments of a compact open baffle speaker system (COBSS) represent a limited number of potential applications in which embodiments of the present invention can be applied. Compact open baffle speaker systems can be utilized in any environment where a compact low frequency or a compact full-range speaker system can be utilized. Examples of potential users and applications of embodiments of compact open baffle speaker systems include, without limitation, recording studios, movie theaters, home theaters, home music listening, office or personal computer use, road or traveling band use, boom boxes or portable stereo systems, car audio, P/A systems, or other environments that can utilize a compact full-range speaker system or compact sub-woofer.

Having fully described at least one embodiment of the present invention, other equivalent or alternative means for implementing a compact open baffle system according to the present invention will be apparent to those skilled in the art. The invention has been described above by way of illustration, and the specific embodiments disclosed are not intended to limit the invention to the particular forms disclosed. The invention is thus to cover all modifications, equivalents, and alternatives falling within the spirit and scope of the following claims.

What is claimed is:

1. A speaker system comprising: a front speaker driver; a shroud mounted to said front speaker driver substantially encasing a cylindrical volume on a rear portion of said front speaker driver; a rear speaker driver comprising similar dimensions to said front speaker driver being axially aligned with said front speaker driver and secured at a determined distance behind said front speaker driver providing containment of the rarefaction pressure of said front speaker drivers rearward movement; and said shroud providing an air gap between said shroud and said rear speaker driver; said shroud could completely enclose the rear of said front speaker driver with an allotted port to allow for driver compliance; an acoustically treated enclosure substantially enclosing a volume on a rear portion of said rear speaker driver; and electrical connections for connecting said front speaker driver and said rear speaker driver to connection terminals for connection to an external driving source such that excursions occur on said front speaker driver and said rear speaker driver when said external driving source is operable and said front speaker driver functions in an open baffle system.

2. The speaker system as recited in claim 1, in which said front speaker driver, shroud, rear speaker driver, and enclosure are secured together by attachment means.

3. The speaker system as recited in claim 1, in which dimensions of said air gap or said port can be controlled for tuning the efficiency of the speaker system.

4. The speaker system as recited in claim 1, in which said connection terminals are mounted on said enclosure.

5. The speaker system as recited in claim 1, further comprising a mounting means for placement of the speaker system on a secure structure.

6. The speaker system as recited in claim 1, in which said front speaker driver and said rear speaker driver have dissimilar resonant frequencies to prevent distortion due to summing.

* * * * *